US007654695B1

(12) United States Patent
Michaelis

(10) Patent No.: US 7,654,695 B1
(45) Date of Patent: Feb. 2, 2010

(54) PIGMENTED COLLAR FOR BI-COLOR LIGHT EMITTING DIODES

(75) Inventor: Paul Roller Michaelis, Louisville, CO (US)

(73) Assignee: Avaya Inc., Basking Ridge, NJ (US)

( * ) Notice: Subject to any disclaimer, the term of this patent is extended or adjusted under 35 U.S.C. 154(b) by 168 days.

(21) Appl. No.: 11/466,216

(22) Filed: Aug. 22, 2006

(51) Int. Cl.
*F21V 9/00* (2006.01)

(52) U.S. Cl. ..... 362/293; 362/230; 362/231

(58) Field of Classification Search ..... 362/293, 362/230, 231, 236, 510
See application file for complete search history.

(56) References Cited

U.S. PATENT DOCUMENTS 4,996,632 A * 2/1991 Aikens ..... 362/560
5,096,280 A * 3/1992 Hamada ..... 359/634
5,311,687 A * 5/1994 Reed ..... 40/502
5,329,435 A * 7/1994 McGuire ..... 362/293
5,749,646 A * 5/1998 Brittell ..... 362/231
6,072,407 A * 6/2000 Shin ..... 340/907
6,417,779 B1 * 7/2002 Noll et al. ..... 340/815.65
6,722,066 B1 * 4/2004 Cheung ..... 40/581
6,796,685 B1 * 9/2004 Nemirow ..... 362/293
7,314,289 B2 * 1/2008 Montagne ..... 362/231
2003/0012032 A1 * 1/2003 Kreutzer et al. ..... 362/542
2003/0137428 A1 * 7/2003 Hutchison ..... 340/815.45
2004/0170016 A1 * 9/2004 Pellegrino ..... 362/231
2005/0152127 A1 * 7/2005 Kamiya et al. ..... 362/84
2005/0168987 A1 * 8/2005 Tamaoki et al. ..... 362/244
2005/0200500 A1 * 9/2005 Wing ..... 340/907
2007/0230170 A1 * 10/2007 Mita et al. ..... 362/231

* cited by examiner

*Primary Examiner*—Jong-Suk (James) Lee
*Assistant Examiner*—David J Makiya
(74) *Attorney, Agent, or Firm*—Sheridan Ross P.C.

(57) ABSTRACT

The present invention is directed to a collar for a multi-color light source that is able to convey not only color but also spatial information to a user to permit the colorblind user to distinguish between the different settings of the light source.

21 Claims, 6 Drawing Sheets

| LED | $R_1$ | $R_2$ | $R_3$ |
|---|---|---|---|
| 1st Color | 1st Color | Not Illuminated | 1st Color |
| 2nd Color | 2nd Color | 2nd Color | Not Illuminated |
| 3rd Color | 3rd Color | 2nd Color | 1st Color |

*Fig. 8*

PIGMENTED COLLAR FOR BI-COLOR LIGHT EMITTING DIODES

FIELD OF THE INVENTION

The invention relates generally to light emitting devices and particularly to bi-colored light emitting diodes.

BACKGROUND OF THE INVENTION

In 1998, Section 508 of the amended Rehabilitation Act (29 USC 794d) required Federal agencies to make electronic and information technology accessible to individuals with disabilities. The law applies to all Federal agencies that develop, procure, maintain, or use electronic and information technology. Since inaccessible technology interferes with a disabled individual's ability to obtain and use information quickly and easily, it is necessary to eliminate barriers in technology posed to individuals with disabilities. For example, when colors are the sole method for indicating the status of a device's elements or controls, colorblind people may find the device difficult to use. Accordingly, devices must provide another method of status indication, such as text labels or shape-coding, combined with the use of color.

A wide variety of electronic devices, such as business telephones, have traditionally used single-color Light Emitting Diodes or LEDs to convey status information. For example, an illuminated green LED might indicate that the corresponding line is available, while an illuminated red LED, associated with the same line, might indicate that the line is busy. Although color is used to convey information, this has not been a problem for colorblind users because the two LEDs are readily discernible to be in different locations. Illustratively, for the colorblind user, the line is available when the LED on the left is illuminated, and is busy when the LED on the right is illuminated.

A bi-color LED is composed of a pair of differently colored LEDs within the same housing. In a typical configuration, when a DC current flows in one direction through the bi-color LED, a first LED of a first color (but not a second LED of a different second color) is illuminated to provide the first color and, when the DC current flows in the opposing direction, the second but not the first LED is illuminated to provide the second color. Bi-color LEDs are often preferred in place of separate multiple single-color LEDs for a variety of reasons; these include a significant reduction in the cost of associated printed circuit boards, and an ability to miniaturize the display and user interface of the associated device. A problem, of course, is that the co-location of different-color emitters within the same LED housing makes it impossible for colorblind users to interpret the information that is being conveyed. Accordingly, such devices are not in compliance with federal procurement requirements.

An inexpensive space-saving solution, that would allow colorblind people to discern the status of bi-color LEDs, would be valuable and beneficial.

SUMMARY OF THE INVENTION

These and other needs are addressed by the various embodiments and configurations of the present invention. The present invention uses light filtration/absorption to direct (e.g., refract and/or reflect) desired wavelengths, or colors, of light to specific locations or regions, thereby providing users not only with the original color information, but also shape differences in the illuminated field that vary depending on the color of light being emitted by the original source of the light.

In a first embodiment, a method of operation of an optical device is provided. The method includes the steps of:

(a) at a first time and first location in proximity to a bi-color light source, passing most, if not all, of all light emitted by the source, regardless of color, thereby causing a first region to be visibly illuminated whenever the light source is illuminated; and (b) at a second time and second location in proximity to the light source, passing most, if not all, of light of a first color that may be emitted by the light source while blocking, at the second location, light of a second color that may emitted by the light source, thereby causing a second region to appear to be illuminated only when light of the first color is being emitted.

As will be appreciated, a physical principle underlying many of the embodiments is that a clear piece of optical material that contains a primary color pigment—such as the colored filter one might use in conjunction with a camera lens—will allow light that is the same color as the pigment to pass through unimpeded, while blocking the passage of light that is of a different primary color. For example, if the filter contains a red pigment, it will allow red light to pass, but will block that transmission of green light. Another physical principle underlying many of the embodiments is that clear optical materials, if appropriately shaped, have the ability to refract and reflect light—i.e., to cause light to leave the material in a direction other than the direction of entry. The first and second locations are located at different places, and at least part of the first region does not overlap the second region and/or vice versa to provide spatial information (e.g., visible change in shape and/or illuminated area) to the user.

In one configuration, the optical device, described herein as an optical collar, surrounds substantially the light source, which is preferably a multi-color Light Emitting Diode or LED. If the optical collar is shaped and mounted appropriately—for example, a solid Lucite™ cone with a narrow shaft through its central axis (for containing the LED) mounted with its wide end facing upward—light originating from the sides of the LED will be refracted upward through the collar when the LED is illuminated. When viewed from above, it will appear as though the LED and the collar are both giving off light.

If the clear collar that surrounds the LED contains a pigment (and/or dye), the collar will tend to pass light of the same color and block the passage of light that is a conflicting color. Illustratively, if the collar contains a red pigment, the collar will appear to be illuminated when the LED is emitting red light but not when the LED is emitting green light. Keeping in mind that this collar is hollow, with a shaft running from top to bottom, the central point of the collar will always appear to be illuminated when viewed from above, regardless of whether the LED is emitting red or green light. In this manner, information that had been conveyed solely by LED color would now also be indicated by a difference in the apparent shape and size of the illumination source, in a manner easily detectable by someone who is colorblind. This would bring any device having collar-equipped bi-LEDs into compliance with Section 508.

Given that some bi-color LEDs can indicate a third color by illuminating both of the primary emitters simultaneously, an alternative configuration for the collar would include more than one pigmented region. Illustratively, when a red-green bi-color LED is emitting both colors of light simultaneously, people who are not colorblind perceive the resulting light to be yellow. If one side of the optical collar were red and the other green, only the red side would appear to be illuminated when the LED was indicating red and only the green side would appear to be illuminated when the LED was indicating green, while both the red and green sides of the collar would appear to be illuminated when the LED was indicating yellow. In this example, each of the three colors would have a corresponding unique area-of-illumination that would be discernible by people who are colorblind.

In another alternative configuration, the collar could be a colored parabolic reflector. It would resemble the unpigmented parabolic reflector that is commonly used in portable flashlights and would be mounted with respect to the bi-color LED in the same way that the reflector in a flashlight mounts with respect to the light bulb. By virtue of being colored, the reflector would achieve the same visual benefits described previously for the refractive collar.

The collars could be a standard component of any equipment in which bi-color LEDs might be employed. Alternatively, assuming that the equipment's faceplate and circuit boards were designed appropriately, the collar could simply be a small, separate, low-cost component that would be installed by the users needing it.

The present invention can provide a number of advantages depending on the particular configuration.

These and other advantages will be apparent from the disclosure of the invention(s) contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The above-described embodiments and configurations are neither complete nor exhaustive. As will be appreciated, other embodiments of the invention are possible utilizing, alone or in combination, one or more of the features set forth above or described in detail below.

BRIEF DESCRIPTION OF THE DRAWINGS

FIG. 8 is a table depicting various LED and collar color combinations according to embodiments of the present invention;

DETAILED DESCRIPTION

Figure 1:
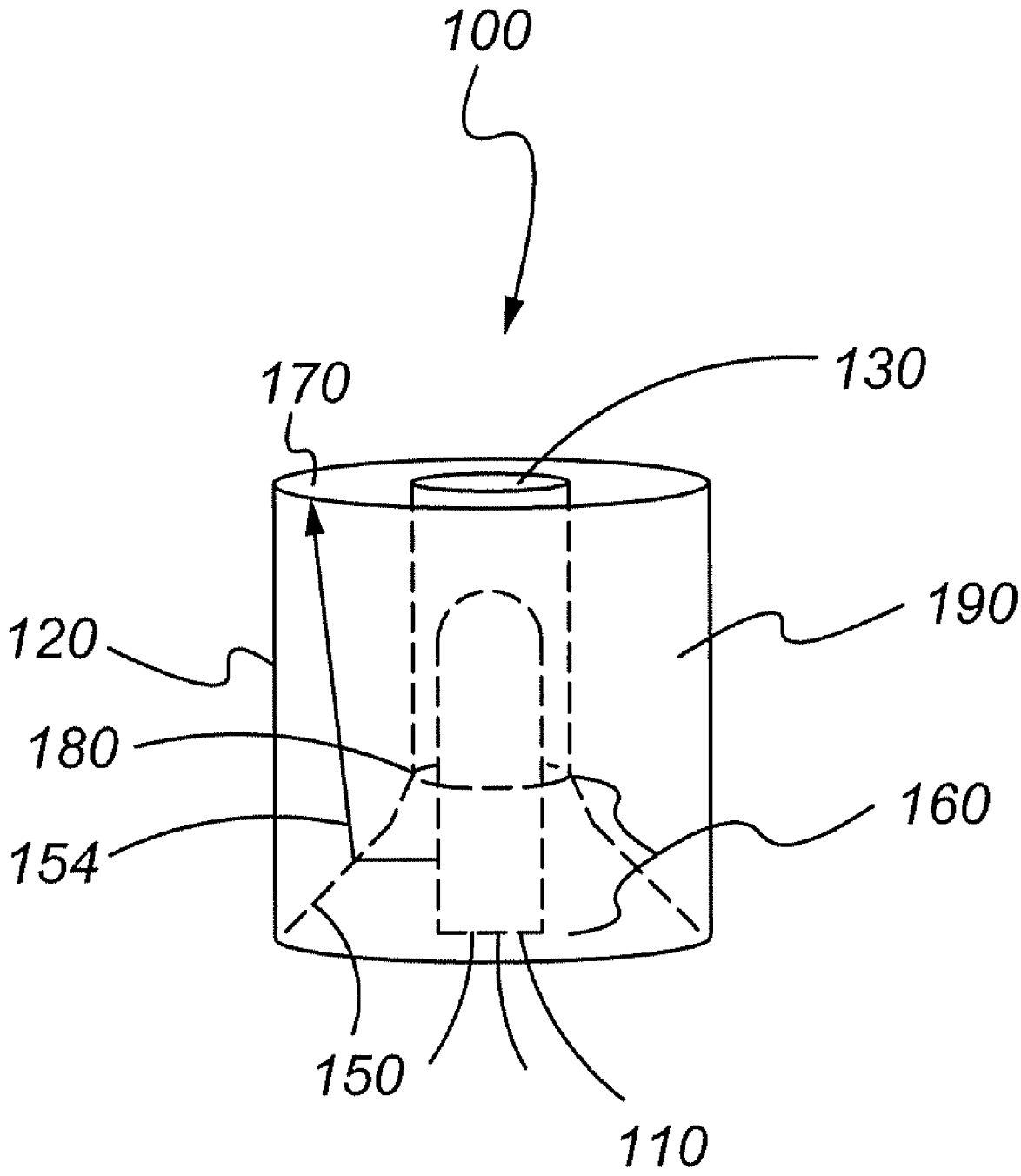
FIG. 1 is a perspective view of a bi-color LED assembly according to an embodiment of the present invention.

The invention will be illustrated below in conjunction with a bi-color Light Emitting Diode or LED assembly. The invention is not limited to use with a particular type of device that uses LED indicator outputs, but instead can apply to any device that uses light emitting indicators and those skilled in the art will recognize that the disclosed techniques may be used in any device that uses a light source as an indicator. Although system 100 in FIG. 1 is well suited for use with a single- or multi-color LED, the LED is only one example of a light source that could be used. For example, the light source in system 100 could be a fluorescent or incandescent light source.

FIG. 1 shows an LED assembly 100 according to an embodiment of the present invention. The assembly 100 includes a bi-color LED 110 and a collar 120 substantially surrounding the LED 110. The collar 120 includes an outer region 190 surrounding a cylindrically shaped collar viewing region 130. The viewing region 130 is positioned along a longitudinal axis of the LED 110. At least a portion of the LED 110 is positioned within the collar viewing region 130.

Although the collar 120 could encase the entire LED 110 from the top of the LED 110 to the bottom of the LED 110, it is not necessary to encase the entire LED 110 for the system 100 to function properly. For example, the collar 120 could encase only part of the LED 110 leaving a bottom part of the LED 110 exposed (as shown). The collar 120 need only be suitably attached to a device or some part of a device in such a way that it approximately encases the LED 110. For example, the collar 120 can be connected to a board that the LED 110 is attached to or to the faceplate of a computational device, such as a telephone, that uses the LED 110 for conveying selected information to the user. Alternatively, the collar 120 could be positioned by engaging the LED 110 itself.

The collar 120 is optically transmissive, translucent, and/or transparent to permit selected wavelengths of light emitted by the LED to pass through the collar 120 for viewing by a user. As used herein, optically transmissive, translucent, and/or transparent requires at least most of the light within a selected wavelength band or distribution emitted from a selected portion of the LED 110 to pass through at least a portion of the collar 120. Preferred optically transmissive, translucent, and/or transparent materials for the collar 120 include plastic, glass, and other suitable materials.

As can be seen in FIG. 1, the lower surface 150 of the collar 120 is substantially conical in shape to provide desired light refraction through the collar 120. The conically shaped surface 150 refracts the light such that it angles towards the viewer as shown by line 154, which represents the path of a ray of light emitted by the LED 110. The shape and/or angular orientation of the surface 150 depends on the index of refraction of the material in the collar 120. Although a conical shape is shown for the surface 150, one of ordinary skill in the art will understand that any suitable shape can be employed that will cause at least most of the rays (photons) of one or more selected wavelength bands of light emitted by the lower portion 160 of the LED 110 to exit the upper surface 170 of the collar 120. The lower portion 160 of the LED 110 is the portion of the LED 110 extending downwardly from the point 180 at which the LED 110 is received by the cylindrically shaped collar viewing region 130.

The upper surface 170 of the collar 120 (or the portion of the collar outside of the collar viewing region 130) could be pigmented (or dyed) (hereinafter "colored") in a number of ways to filter a selected light wavelength band to provide desired visual effects to a user. To provide this filtering effect, one or more pigments is/are positioned in the path of light illuminated by the light source 110. For example, the pigments(s) can be on the exterior of the upper surface 170 and/or region 130, on the surface 150, and/or within the collar 120 and/or region 130. In one configuration, the surface 170 is colored a second color in its entirety. The second color (defined by a second wavelength band) is one of the colors of light emitted by the LED 110 (which is configured as a bi-color LED). A first color of light (defined by a first wavelength band) emitted by the LED is absorbed (or filtered) by the collar 120. In other words, at least most of the light in the first wavelength band is not passed by the collar 120 for viewing by the user while at least most of the light in the second wavelength band is passed by the collar 120 for viewing by the user. To create this light filtering effect, the first and second colors are preferably primary colors on the optical color wheel. For light, the primary colors are green, red, and blue. Accordingly, the first color is preferably one of green, red, and blue and the second color another of green, red, and blue. (Note that LEDs, capable of emitting green, red, or blue light, are readily available and are commonly use in electronic equipment.)

The collar viewing region 130, on the other hand, preferably passes at least most of the light in the first and second wavelength bands. In other words, when the LED emits light of the first color the user sees the first color as being emitted through the collar viewing region 130, and when the LED emits light of the second color the user also sees the second color as being emitted through the region 130.

Figure 4A:
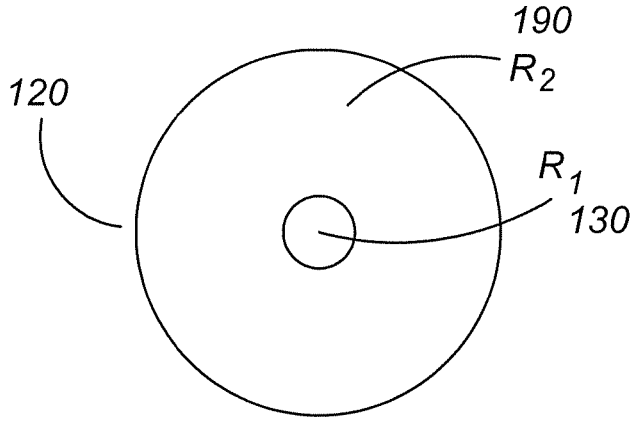
FIGS. 4A and B are plans view of an illuminated LED assembly according to an embodiment of the present invention.
Figure 4B:
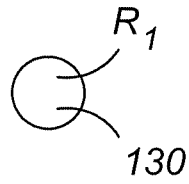

The LED assembly 100 can provide information to the user not only by the vehicle of color but also of spatial information (e.g., shape and/or size). With reference to FIG. 4, when a DC current is passed through the LED 110 in a second direction so that the LED 110 emits light of the second color, the second color will appear to the user as being emitted by the upper surface 170 (or the second region R2) and the collar viewing region 130 (or first region R1) to provide the circularly shaped image of FIG. 4A. When a DC current is passed through the LED 110 in a first opposite direction so that the LED 110 emits light of the first color, the first color will appear to the user as being emitted by the first region but not the second region to provide the much smaller circularly shaped image of FIG. 4B. As can be seen from FIGS. 4A and B, the size of the illuminated areas are different, which therefore provides spatial information in addition to color information so that colorblind users can discern readily device status information intended to be conveyed by the different colors of light.

It is to be understood, however, that the collar viewing region 130 could be colored an opposite color (e.g., the first color) from the rest of the collar 120 according to the concepts of the present invention. In this configuration, when the LED 110 has the second color, the second region 130 but not the first region 170 is illuminated, and, when the LED 110 has the first color, the first region 130 but not the second region 170 is illuminated.

Figure 2:
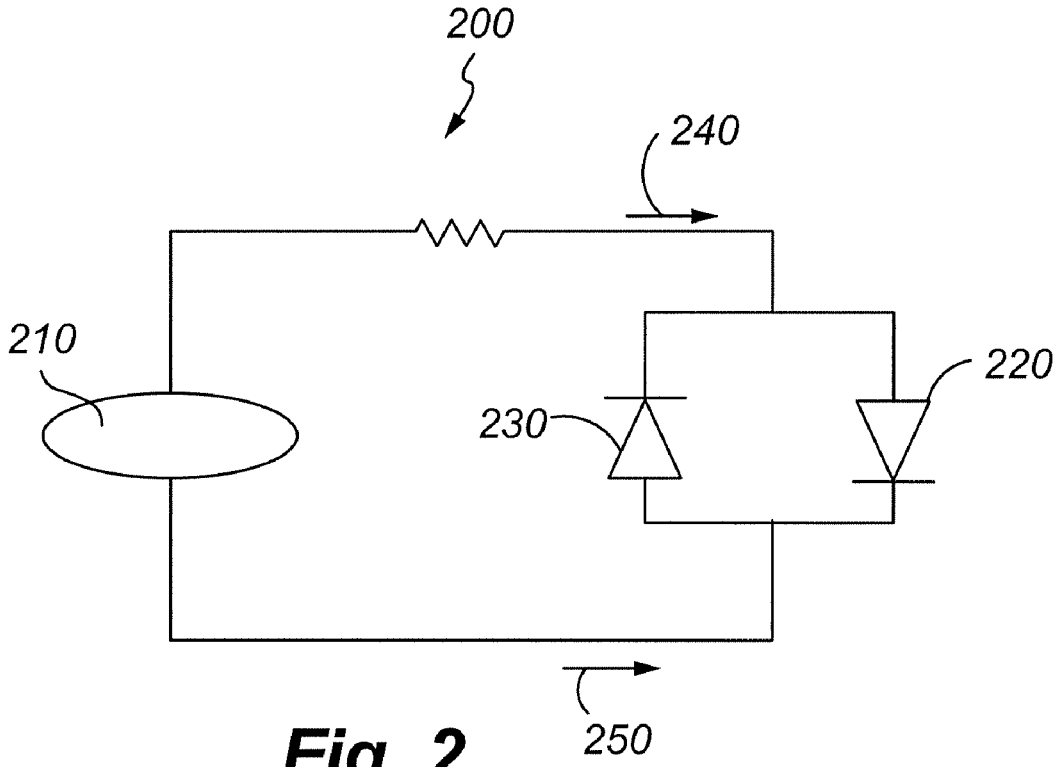
FIG. 2 is a circuit diagram of a bi-color LED assembly according to an embodiment of the present invention.

A circuit diagram used to pulse DC electrical energy through the LED 110 in the first and second directions 240 and 250 is shown in FIG. 2. The circuit 200 includes a power source 210 and the first and second diodes 220 and 230 connected electrically in parallel. When DC electrical energy is pulsed in the first direction 240, diode 230 blocks substantially the passage of electrical energy while diode 220 passes substantially the electrical energy. As a result, diode 230 will not emit light while diode 220 will. When DC electrical energy is pulsed in the second direction 250, diode 220 blocks substantially the passage of electrical energy while diode 230 passes substantially the electrical energy. As a result, diode 220 will not emit light while diode 230 will. As will be appreciated, when the diodes are energized each emits a different wavelength distribution, or color, of light.

Figure 5:
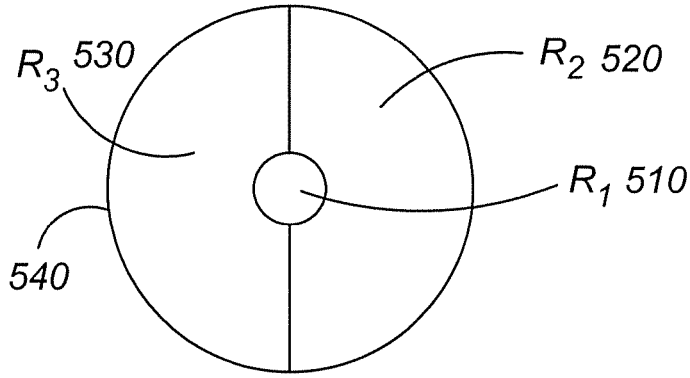
FIG. 5 is a plan view of an illuminated LED assembly according to an embodiment of the present invention.

In another variation, the collar 120 is colored with multiple (primary) colors. This effect is depicted in FIG. 5, which depicts a collar 540 having first, second, and third (nonoverlapping) regions 510, 520, and 530 of differing colors. The second and third regions have approximately the same surface areas. In a preferred configuration, the second and third regions 520 and 530 are colored while the first region 510 is not (i.e., is clear). It will be appreciated, however that the first region 510 may be colored with a color different from the colors of the second and third regions 520 and 530. As noted previously, the colors of the second and third regions are preferably different primary colors.

Figure 6:
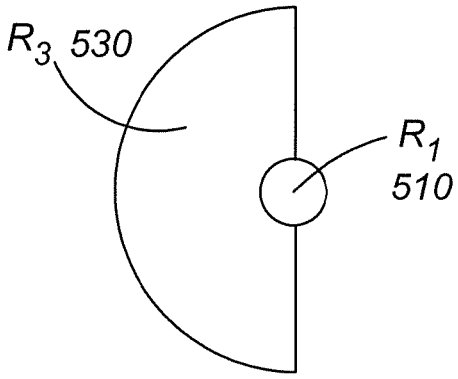
FIG. 6 is a plan view of an illuminated LED assembly according to an embodiment of the present invention.
Figure 7:
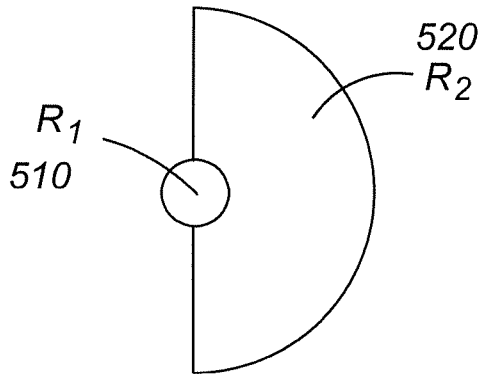
FIG. 7 is a plan view of an illuminated LED assembly according to an embodiment of the present invention.

FIGS. 6 and 7 depict the different illuminated images seen by the user when DC electrical energy is pulsed in the first and second directions 240 and 250. In FIG. 7, when electrical energy is pulsed in the second direction, the LED 110 will emit light of the second color that readily passes through the second region 520 (which is colored to have the second color) and through the viewing region 510 but not through the third region 530 (which is colored to have the first color), and, as in FIG. 6, when electrical energy is pulsed in the first direction, the LED will emit light of the first color that readily passes through the third region 530 and through the viewing region 510 but not through the second region 520.

Although the above configurations are discussed with reference to the upper surface 170 of the collar 120 having only two differently colored regions, it is to be understood that more than two colored regions may be employed. It is to be further understood that the collar 120 color need only be approximately opposite on the color wheel from one of the colors of the LED 110 and that the relative sizes of the differently colored regions can have unequal surface areas. For example, the collar 120 could be divided into two regions such that, from the top, the collar 120 appears to be approximately divided into a one-third region and a two-thirds region. Such a disparate division would emphasize visually one state of the device more than another state of the device. In another variation, the collar 120 can be divided into regions defining a pattern, such as multiple interspersed second and third regions.

Figure 9:
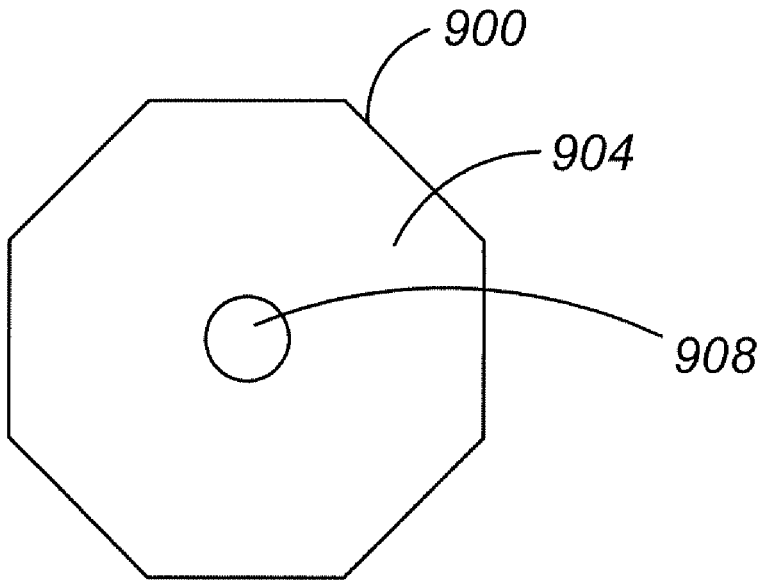
FIG. 9 is a plan view of a collar according to an embodiment of the present invention.
Figure 10:
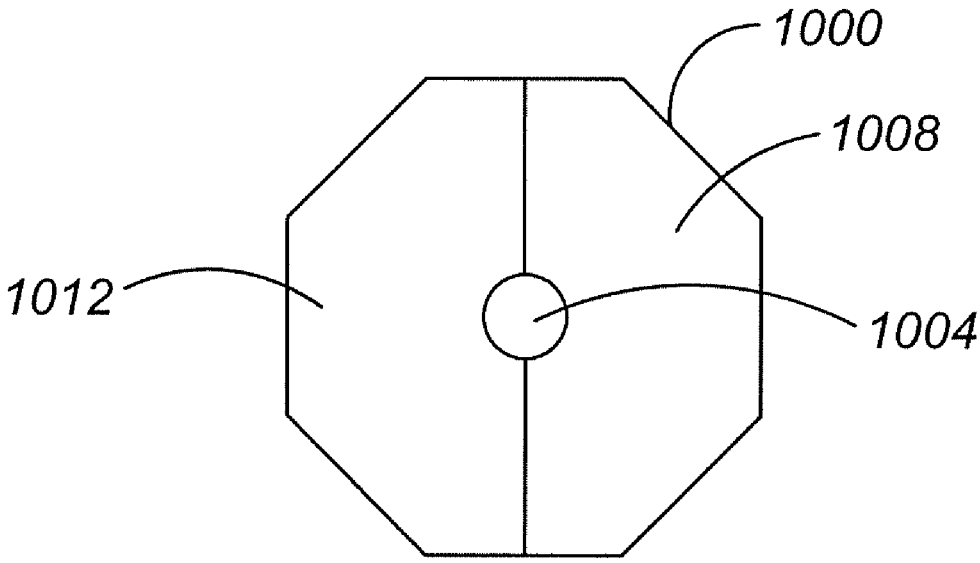
FIG. 10 is a plan view of a collar according to an embodiment of the present invention.

The shape of the collar can be varied. For example, FIG. 9 depicts a collar 900 having an octagonal shape. The collar is divided into a colored (or uncolored) outer region 904 and an uncolored (or colored) viewing region 908. As noted above, when both the outer region 904 and viewing region 908 are colored, they are colored differently. In preferred configurations, only one of the outer and viewing regions 904 and 908 are colored with the other being uncolored. FIG. 10 depicts a collar 1000 having an octagonal shape and first, second, and third regions 1004, 1008, and 1012. Although each of the first, second, and third regions can be differently colored, only two of the first, second, and third regions are colored with the remaining region being uncolored. Examples of other shapes for the outer diameter collar include elliptical, square, pentagonal, or hexagonal to name a few. Furthermore, the shape of the viewing region can be varied as well.

To illustrate why the shapes of the collar and viewing region could be of importance in an actual implementation, note that the octagonal shape depicted in FIG. 9 is the same as that commonly associated with stop signs. If, for example, only a central circular region appeared to be illuminated when the LED was emitting green light, while an entire "stop sign" shape appeared to be illuminated when the LED was emitting red light, this would provide unambiguous feedback to users who are unable to distinguish red and green.

Figure 3:
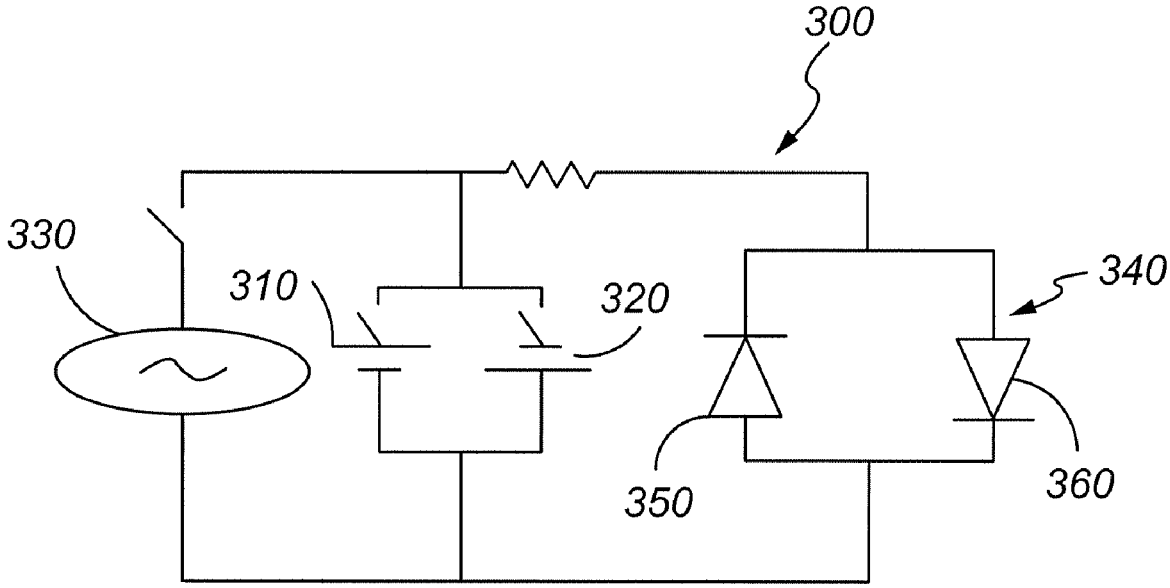
FIG. 3 is a circuit diagram of a bi-color LED assembly according to an embodiment of the present invention.

In another embodiment, AC current is pulsed through the LED collar assembly 100 to provide desired multi-color visual effects. An example of an AC circuit is shown in FIG. 3. The circuit 300 has two power sources for tri-modal operation, namely DC power sources 310 and 320 and AC power source 330. The term 'power source' as used herein should be understood to include DC power that is forward or reverse biased, AC power, any circuit that allows interchangeability between DC and AC power or any combination thereof. As illustrated in FIG. 3 the power provided to the LED 340 could be DC power either forward biased 310 or reverse biased 320 or the power could be provided by an AC power source 330. Furthermore, in different embodiments, the circuit could include, but is not limited to, an AC power source with a switch, and a DC power source with a switch for each of a forward biased power source and a reverse biased power source, or the circuit could contain an AC power source with a switched converter that converts the AC power to DC power or could be any combination of the aforementioned embodiments.

In the first mode, DC electrical energy is pulsed through the circuit 300 in a first direction to cause the bi-color LED (composed of oppositely facing diodes 350 and 360) to emit a first color. In the second mode, DC electrical energy is pulsed through the circuit 300 in the second direction to cause the bi-color LED to emit a second color. Finally, in the third mode, AC electrical energy is pulsed through the circuit 300 to intermittently and alternately energize the diodes 350 and 360 to cause the bi-color LED to emit a third color (which is the combination of the first and second colors). For example, when the first and second colors are red and green the third color will be yellow.

With reference to FIG. 5, when the LED 110 is operated in three modes the appearance of the collar 120 is provided by the table of FIG. 8. With reference to FIG. 5, the particular configuration used for FIG. 8 is the first region 510 being uncolored, the second region 520 having the second color, and the third region 530 having the first color. As can be seen from FIG. 8, when the LED emits light of the first color (or operates in the first mode), the first and third regions are the first color and the second region 520 is not illuminated; when the LED emits light of the second color (or operates in the second mode) the first and second regions are the second color and the third region is not illuminated; and when the LED emits light of the third color (or operates in the third mode) the first region has the third color, the second region has the second color, and the third region has the first color.

In any of the above embodiments, all or part of the outer surface of the collar can have a frosted, or optically dispersive, coating so that the illuminated collar is viewable not only from overhead but also from off to the side. The coating will cause the light rays, which are substantially collimated before reaching the upper surface 100, to be dispersed in a variety of direction to produce substantially uncollimated or scattered light. This is generally caused by the coating refracting light rays in a variety of directions. A common coating includes multiple small light reflective or dispersing particles oriented randomly in the coating.

Figure 11:
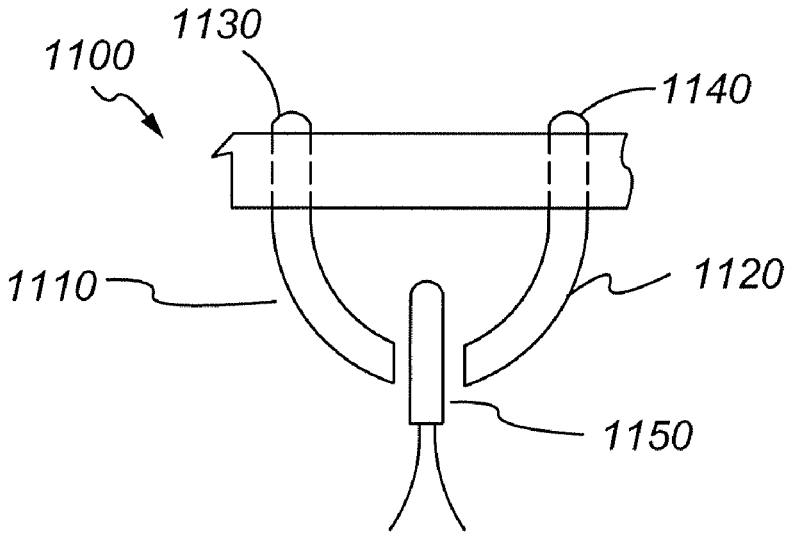
FIG. 11 is a cross-sectional view of an LED assembly according to an embodiment of the present invention.

With reference to FIG. 11, the color of the light source could be transmitted to the surface for visibility in a manner other than using a collar encasing an LED. As illustrated in FIG. 11, colored light could be transmitted from the LED 1150 to the surface by first and second differently colored light pipes 1110 and 1120. The light pipes could be pigmented in different ways. For example, the first light pipe 1110 could be uncolored (to pass both first and second colors of light emitted by the LED 1150) and the second light pipe 1120 could be colored (to pass only one of the first and second colors). Assuming that the second light pipe 1120 has the second color, when the LED 1150 emits light of the second color the light will be transmitted to the surface to become visible at both transparent illumination points 1130 and 1140, and when the LED 1150 emits light of the first color the second light pipe 1120, but not the first light pipe 1110, will block the light from being transmitted to the surface, whereby only the first illumination point 1130 will be illuminated. In this embodiment, light pipe 1110 will transmit both lights of the first and second colors causing them to be visible at the transparent illumination point, 1130. By way of another example, the first light pipe 1110 could be colored with the first color and the second light pipe 1120 with the second color. In this system, the first light pipe 1110 will transmit light of the first color but not the second color to the transparent illumination point 1130, and the second light pipe 1120 will transmit light of the second color but not the first color to the second transparent illumination point 1140. If the LED 1150 is emitting a third color, an option enabled by an AC power source, then both transparent illumination points 1130 and 1140 will be illuminated. This embodiment, as all the other embodiments previously discussed, provides a spatial vehicle other than color alone to allow the user to differentiate between a first color from the LED 1150 and a second color from the LED 1150. The vehicle provides two separate and spaced apart transparent illumination points that will illuminate in distinct ways depending on the LED color emitted.

Figure 12:
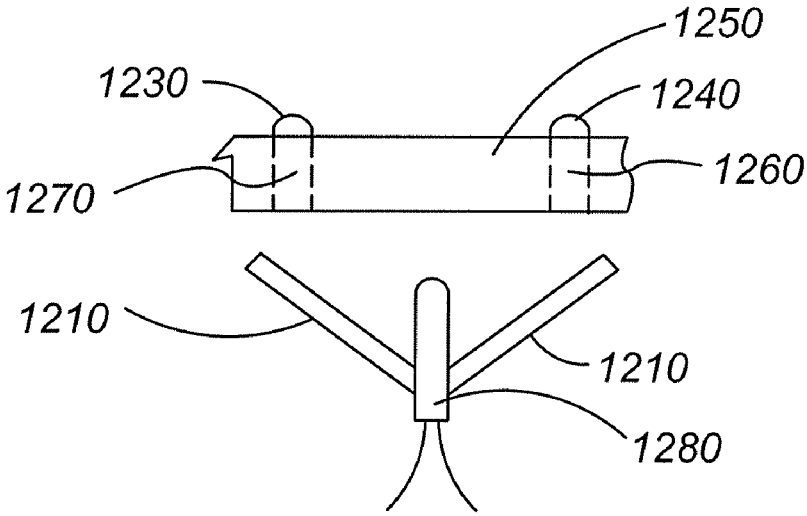
FIG. 12 is a cross-sectional view of an LED assembly according to an embodiment of the present invention.

With reference now to FIG. 12, a method of transmitting the LED color to be visible at the surface using a conically shaped reflector 1210 is illustrated. As illustrated in FIG. 12, the uncolored reflector 1210 reflects equally light of the first and second colors emitted by the LED 1280 toward the cover plate 1250. First and second light pipes 1260 and 1270 (both of which have different colors or one of which is colored and the other uncolored) transmit light in a number of ways, including those discussed in FIG. 11 above where light of the first and second colors are transmitted to the transparent illumination points 1230 and 1240.

Another embodiment of FIG. 12 is to have a (parabolic) reflector having differently colored regions. In this embodiment, a first region of the bicolor reflector 1210 reflects the light of the first color of the LED 1280 towards the first illumination point 1230 and a second region of the bicolor reflector reflects light of the second color of the LED 1280 towards the second illumination point 1240. Accordingly, when the LED 1280 emits light of the first color, then transparent first illumination point 1230 but not the second illumination point 1240 will be illuminated with a first color and when the LED 1280 emits light of the second color, the second illumination point 1240 but not the first illumination point 1230 will be illuminated with the second color. Additionally, when the LED 1280 emits a third color, both regions of the bicolor reflector will reflect the third color and both the first and second transparent illumination points 1230 and 1240 will be illuminated. In this embodiment, while it is not necessary to have light pipes 1260 and 1270 selectively transmit different colors as in the embodiment illustrated in FIG.

11, it is another possible embodiment if the light pipes 1260 and 1270 could selectively transmit colors to the surface for visibility.

Figure 13:
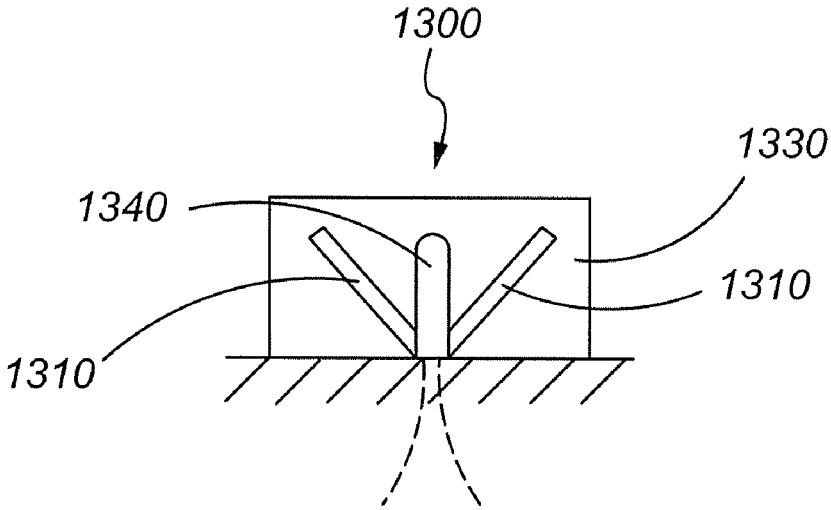
FIG. 13 is a cross-sectional view of an LED assembly according to an embodiment of the present invention.

With reference to FIG. 13, a bicolor reflector system 1300 is illustrated. In FIG. 13, the conically shaped bicolor reflector 1310 and LED 1340 are encased in an optically transmissive, transparent, and/or translucent casing 1330. In system 1300, a first region of the bicolor reflector 1310 reflects light of the first color of the LED 1340 and the second region of the bicolor reflector 1310 reflects light of the second color of the LED 1340 and both regions of the bicolor reflector reflects light of the third color of the LED 1340. As with the other embodiments, this embodiment also provides a method other than color, allowing the user to differentiate between the first color of the LED 1340, the second color of the LED 1340, and the third color of the LED 1340 by providing distinct illumination patterns dependent upon the emission color of the LED 1340.

A number of variations and modifications of the invention can be used. It would be possible to provide for some features of the invention without providing others.

By way of example, the color absorbing material can be applied only to a surface of the collar rather than being distributed throughout the internal volume of the collar. Applying a color absorbing material to an otherwise fully optically transparent collar can be less expensive than coloring the entire volume of the selected portion of the collar.

Although the present invention describes components and functions implemented in the embodiments with reference to particular standards and protocols, the invention is not limited to such standards and protocols. Other similar standards and protocols not mentioned herein are in existence and are considered to be included in the present invention. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present invention.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An optical device, comprising:

(a) a multicolor light source, the light source being operable to emit a first, but not a second, color of light in a first mode and the second, but not the first, color of light in a different and nonoverlapping second mode;

(b) a collar surrounding substantially the light source, the collar comprising one of a refractive and reflective surface to direct light upwardly towards an upper surface of the collar, the upper surface of the collar comprising first, second and third regions, the first region passing substantially both the first and second colors of light, the second region passing substantially the second, but not the first, color of light, and the third region passing substantially the first, but not the second, color of light, whereby a viewer viewing the upper surfaces during each of the first and second modes perceives differing illuminated shapes.

2. The optical device of claim 1, wherein the first and second modes occur at different times, wherein the multicolor light source is a bi-color Light Emitting Diode ("LED"), wherein the first region has the first color and the second region has the second color, and wherein the first color is different from the second color.

3. The optical device of claim 2, wherein the first and second colors are each substantially one of red, blue, and green and wherein the one of a refractive and reflective surface is a refractive surface.

4. The optical device of claim 1, wherein the first color of light illuminates simultaneously the first and third regions in the first mode and the second color of light illuminates simultaneously the first and second regions in the second mode.

5. The optical device of claim 1, wherein the first region has neither the first nor second colors.

6. The optical device of claim 1, wherein the one of a refractive and reflective surface is a reflective surface.

7. The optical device of claim 1, wherein the multicolor light source produces, in a third mode, a third color, the third color being a combination of the first and second colors, and wherein, in the third mode, the first region produces the third color, the second region the second color, and the third region the first color.

8. An optical device, comprising:

(a) a multicolor light source, the light source being operable to emit a first, but not a second, color of light in a first mode and the second, but not the first, color of light in a different and nonoverlapping second mode;

(b) a collar surrounding substantially the light source, the collar comprising one of a refractive and reflective surface to direct light upwardly towards an upper surface, the upper surface comprising at least first and second regions, the first region passing substantially both the first and second colors of light and the second region passing substantially the second, but not the first, color of light, whereby a viewer viewing the upper surfaces during each of the first and second modes perceives differing illuminated shapes.

9. The optical device of claim 8, wherein the one of a refractive and reflective surface is a refractive surface and wherein the collar comprises a third region having the first color, wherein the third region passes substantially the first, but not the second, color of light.

10. The optical device of claim 8, wherein the one of a refractive and reflective surface is a reflective surface and wherein the collar comprises a third region having the first color, wherein the third region passes substantially the first, but not the second, color of light.

11. The optical device of claim 9, wherein the multicolor light source produces, in a third mode, a third color, the third color being a combination of the first and second colors, and wherein, in the third mode, the first region produces the third color, the second region the second color, and the third region the first color.

12. The optical device of claim 8, wherein the collar comprises a reflective surface.

13. The optical device of claim 8, wherein the multi-color light source produces the first color when energized by electric current flowing in a first direction and the second color when energized by electric current flowing in a second direction opposite to the first direction.

14. The optical device of claim 8, wherein the first and second modes occur at different times, wherein the multi-color light source is a bi-color Light Emitting Diode ("LED").

15. A method, comprising:

(a) emitting, in a first mode and from a multicolor light source, a first, but not a second, color of light;

(b) emitting, in a second mode and from the multicolor light source, the second, but not the first, color of light, the first and second modes being different and nonoverlapping; and (c) directing, by one of a refractive and reflective surface, emitted light to an upper surface of a collar surrounding substantially the light source, the upper surface comprising at least first and second regions, the first region passing substantially both the first and second colors of light and the second region passing substantially the second, but not the first, color of light, whereby a viewer viewing the upper surfaces during each of the first and second modes perceives differing illuminated shapes.

16. The method of claim 15, wherein the one of a refractive and reflective surface is a refractive surface and wherein the collar comprises a third region having the first color, wherein the third region passes substantially the first, but not the second, color of light.

17. The method of claim 15, wherein the one of a refractive and reflective surface is a reflective surface and wherein the collar comprises a third region having the first color, wherein the third region passes substantially the first, but not the second, color of light.

18. The method of claim 16, wherein the multicolor light source produces, in a third mode, a third color, the third color being a combination of the first and second colors, and wherein, in the third mode, the first region produces the third color, the second region the second color, and the third region the first color.

19. The method of claim 15, wherein the collar comprises a reflective surface.

20. The method of claim 15, wherein the multi-color light source produces the first color when energized by electric current flowing in a first direction and the second color when energized by electric current flowing in a second direction opposite to the first direction.

21. The method of claim 15, wherein the first and second modes occur at different times, wherein the multi-color light source is a bi-color Light Emitting Diode ("LED").

* * * * *